US006769464B1

(12) United States Patent
Jenkin

(10) Patent No.: US 6,769,464 B1
(45) Date of Patent: Aug. 3, 2004

(54) LOG SPLITTER SYSTEM

(76) Inventor: Sandra L. Jenkin, 1715 N. 6th St., Bismarck, ND (US) 58501

( * ) Notice: Subject to any disclaimer, the term of this patent is extended or adjusted under 35 U.S.C. 154(b) by 0 days.

(21) Appl. No.: 10/409,931

(22) Filed: Apr. 8, 2003

(51) Int. Cl.[7] ..... B27L 7/06
(52) U.S. Cl. ..... 144/193.2; 144/195.1
(58) Field of Search ..... 144/193.1, 193.2, 144/195.2, 195.3, 195.8, 195.1, 195.7, 195.9

(56) References Cited

U.S. PATENT DOCUMENTS 4,019,549 A 4/1977 Williams ..... 144/193
4,236,556 A * 12/1980 Smith ..... 144/195.1
4,444,231 A * 4/1984 Dillon ..... 144/195.1
6,408,907 B1 * 6/2002 Lantz ..... 144/195.1
6,520,226 B1 * 2/2003 Smith ..... 144/366
6,609,547 B1 8/2003 Machkovech ..... 144/366
2003/0155637 A1 * 8/2003 Alexander ..... 144/195.1

* cited by examiner

*Primary Examiner*—Allen Ostrager
*Assistant Examiner*—W. Donald Bray

(57) ABSTRACT

A log splitter system for splitting logs in an efficient manner. The log splitter system includes a support beam, a loader connecting structure for attaching to a tractor loader, a main engaging member slidably attached to the support beam, a splitting wedge attached to an end of the support beam, and an actuator unit attached to the main engaging member. The actuator unit forces the main engaging member toward the splitting wedge with a log positioned between thereof thereby splitting the log.

20 Claims, 9 Drawing Sheets

LOG SPLITTER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to log splitters and more specifically it relates to a log splitter system for splitting logs in an efficient manner.

2. Description of the Related Art

Log splitting devices have been in use for years. Conventional log splitting devices are comprised of a stationary support frame, a hydraulic cylinder and a splitting wedge in opposition to the hydraulic cylinder.

The main problem with conventional log splitting devices is that they are cumbersome and difficult to transport to remote locations. Another problem with conventional splitting devices is that they require the user to bring the logs to the splitting device. A further problem is that conventional splitting devices require the user to position the log upon the splitting device which can require significant amounts of physical exertion. Examples of prior art patents which attempt to provide a mobile log splitting apparatus are illustrated in U.S. Pat. Nos. 6,520,226 and 6,408,907.

While these devices may be suitable for the particular purpose to which they address, they are not as suitable for splitting logs in an efficient manner. Conventional log splitting devices do not provide an efficient system for splitting logs.

In these respects, the log splitter system according to the present invention substantially departs from the conventional concepts and designs of the prior art, and in so doing provides an apparatus primarily developed for the purpose of splitting logs in an efficient manner.

SUMMARY OF THE INVENTION

In view of the foregoing disadvantages inherent in the known types of log splitters now present in the prior art, the present invention provides a new log splitter system construction wherein the same can be utilized for splitting logs in an efficient manner.

The general purpose of the present invention, which will be described subsequently in greater detail, is to provide a new log splitter system that has many of the advantages of the log splitters mentioned heretofore and many novel features that result in a new log splitter system which is not anticipated, rendered obvious, suggested, or even implied by any of the prior art log splitters, either alone or in any combination thereof.

To attain this, the present invention generally comprises a support beam, a loader connecting structure for attaching to a tractor loader, a main engaging member slidably attached to the support beam, a splitting wedge attached to an end of the support beam, and an actuator unit attached to the main engaging member. The actuator unit forces the main engaging member toward the splitting wedge with a log positioned between thereof thereby splitting the log.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a log splitter system that will overcome the shortcomings of the prior art devices.

A second object is to provide a log splitter system for splitting logs in an efficient manner.

Another object is to provide a log splitter system that reduces the amount of time and manual labor required to split logs.

An additional object is to provide a log splitter system that is attachable to a tractor such as a skid steer loader.

A further object is to provide a log splitter system that does not require more than one worker.

Another object is to provide a log splitter system that allows the operator to push logs into a pile and manipulate logs on the ground.

A further object is to provide a log splitter system that reduces the likelihood of physical injuries to workers.

Another object is to provide a log splitter system that is capable of severing tree limbs.

A further object is to provide a log splitter system that is capable of splitting logs of various lengths, wood types and diameters.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims. dr

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview of Invention

Figure 1:
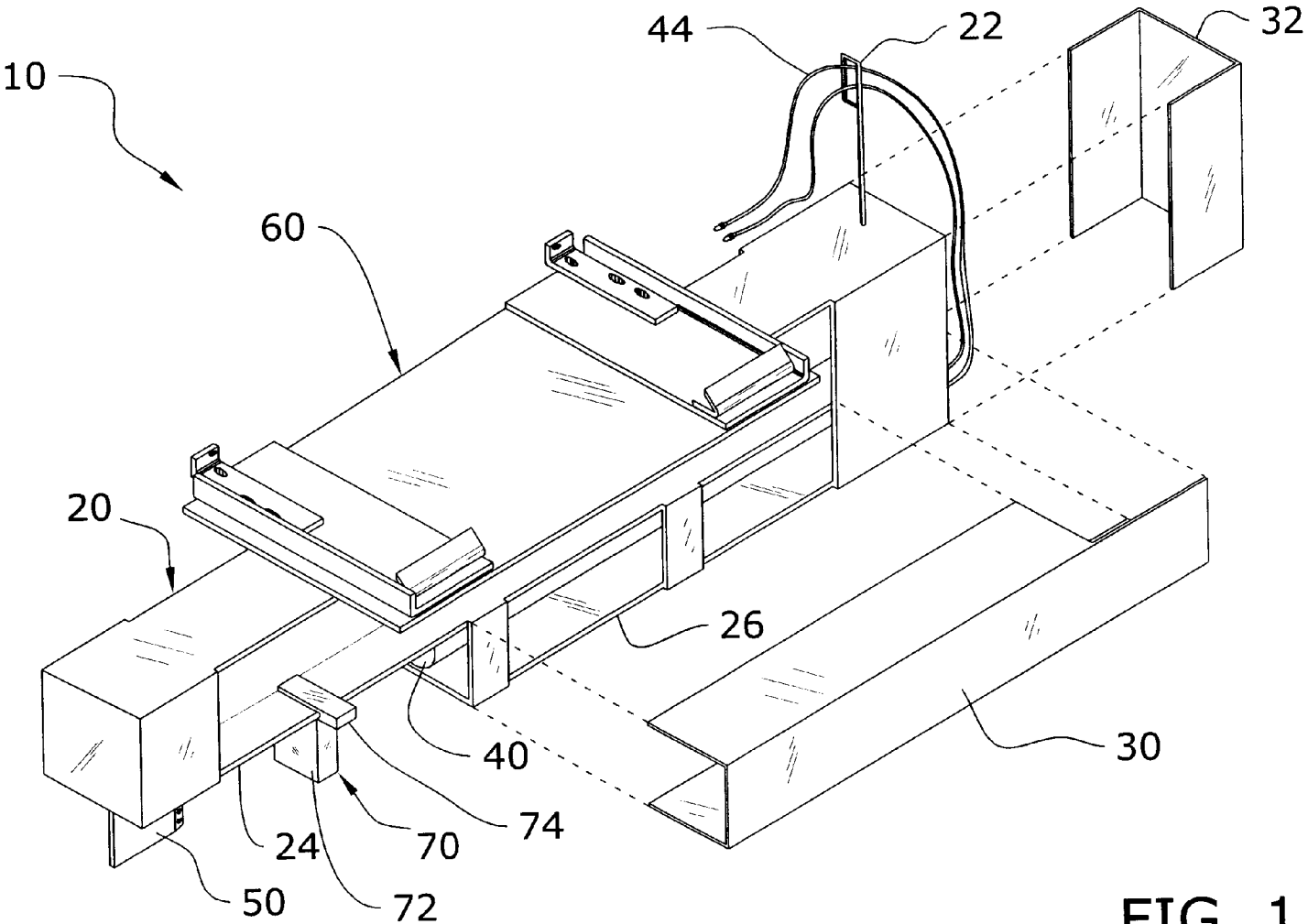
FIG. 1 is an exploded upper perspective view of the present invention.

Turning now descriptively to the drawings, in which similar reference characters denote similar elements throughout the several views, FIGS. 1 through 9 illustrate a log splitter system 10, which comprises a support beam 20, a loader connecting structure 60 for attaching to a tractor loader, a main engaging member 70 slidably attached to the support beam 20, a splitting wedge 50 attached to an end of the support beam 20, and an actuator unit 40 attached to the main engaging member 70. The actuator unit 40 forces the main engaging member 70 toward the splitting wedge 50 with a log 12 positioned between thereof thereby splitting the log 12.

B. Support Beam

Figure 3:
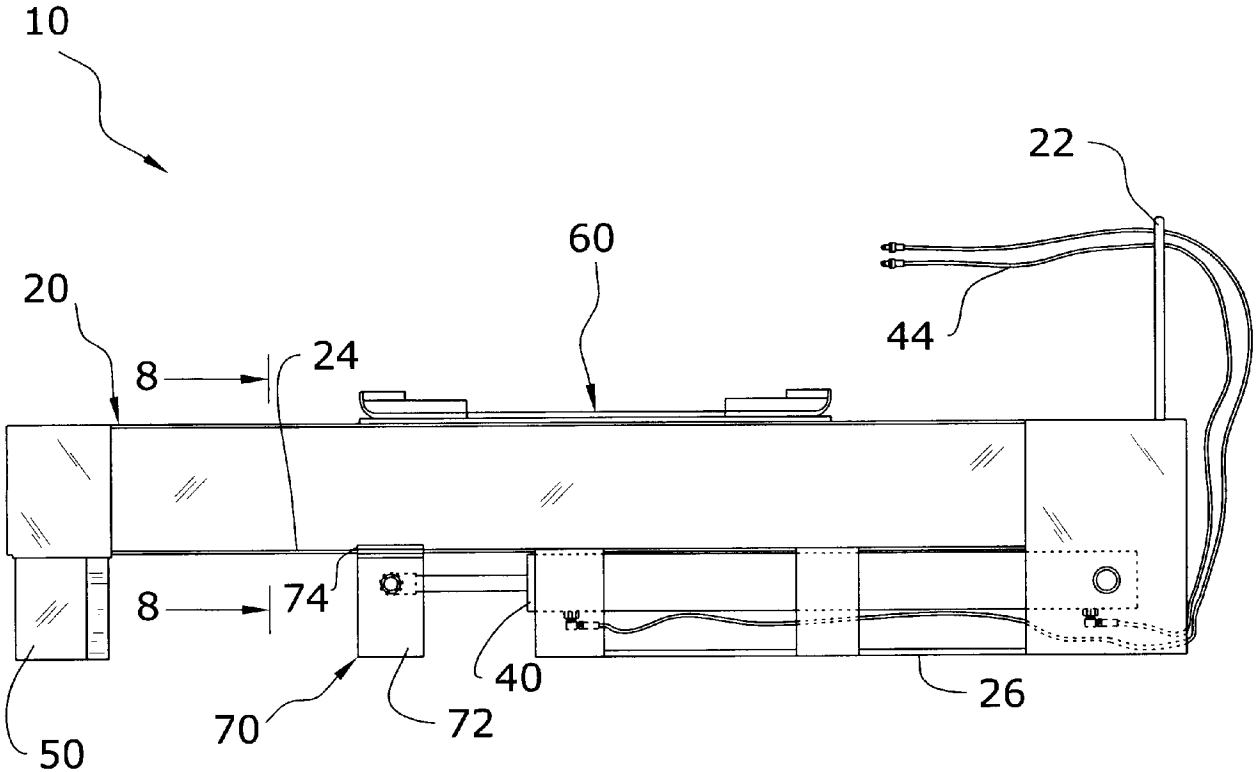
FIG. 3 is a front view of the present invention.
Figure 4:
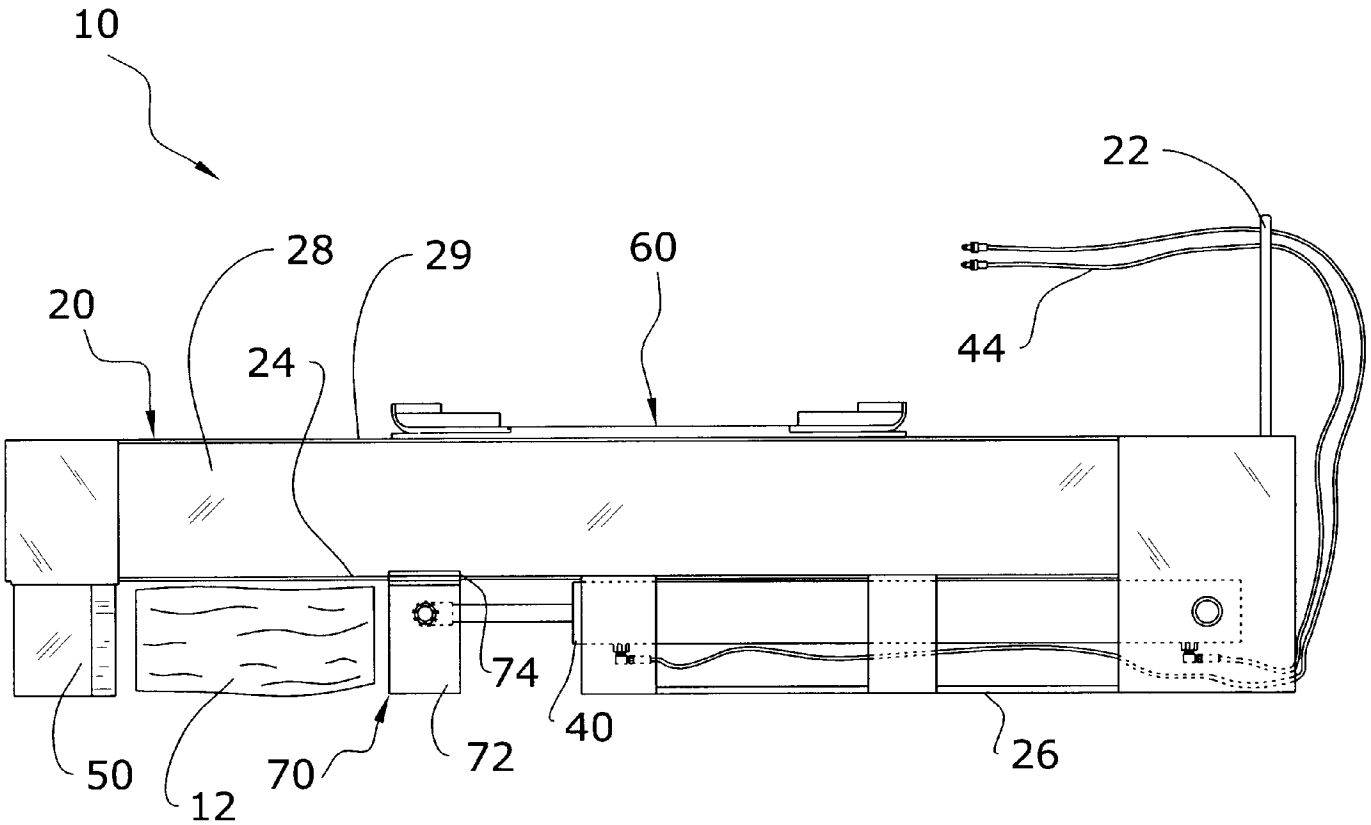
FIG. 4 is a front view of the present invention loosely positioned about a log.
Figure 5:
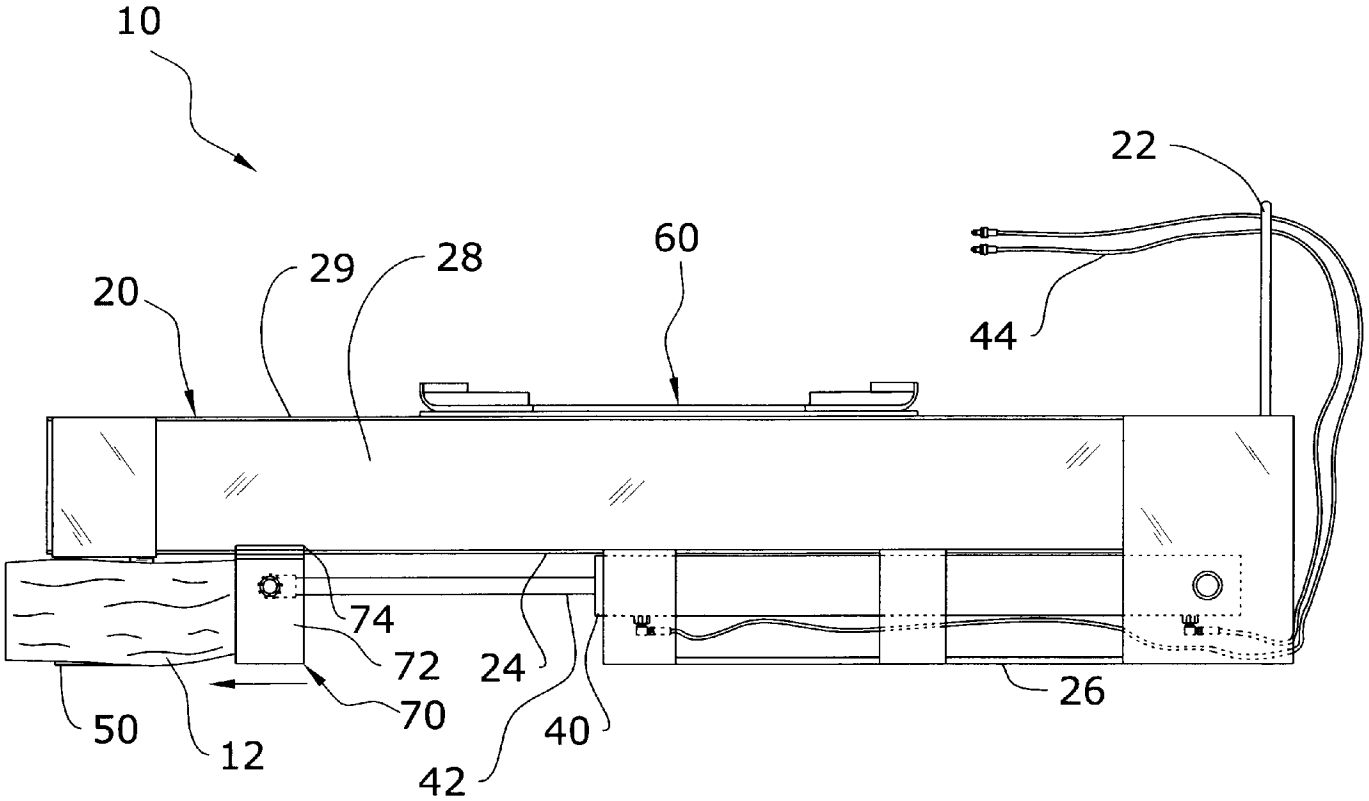
FIG. 5 is a front view of the present invention splitting a log.

The support beam 20 is comprised of an elongate structure as best illustrated in FIGS. 3 through 5 of the drawings. The support beam 20 is preferably comprised of a straight rigid structure.

Figure 8:
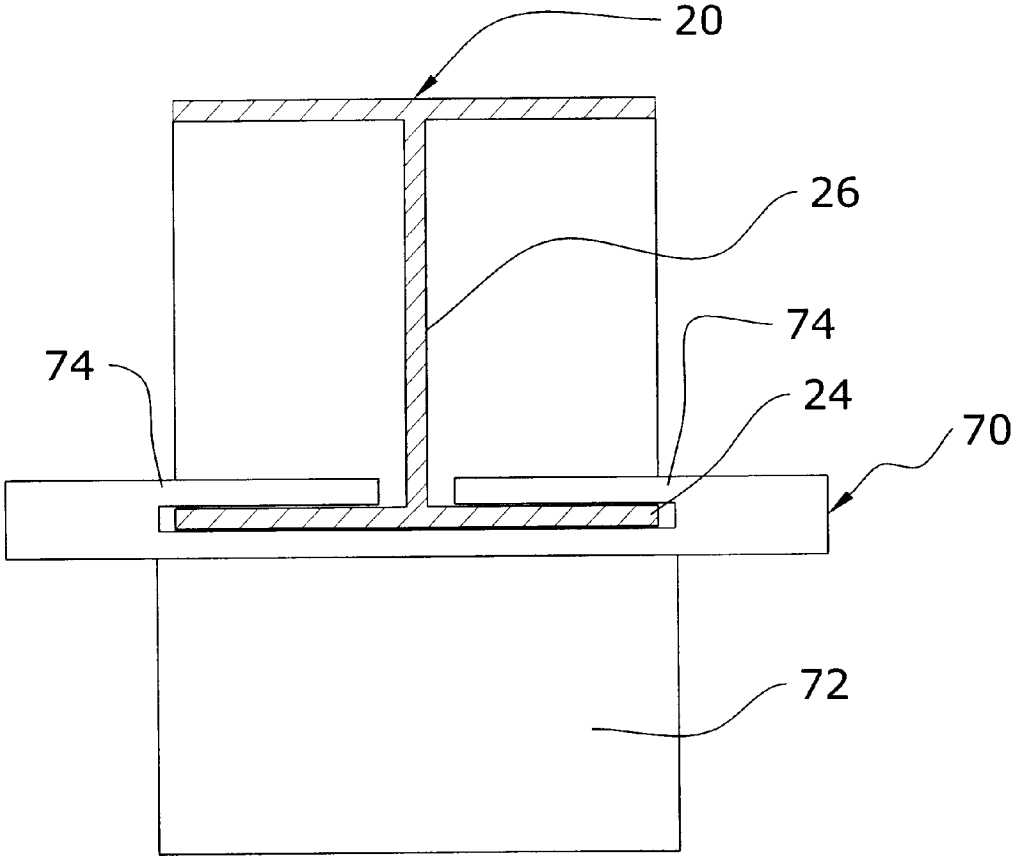
FIG. 8 is a cross sectional view taken along line 8—8 of FIG. 3.

The support beam 20 preferably is comprised of an I-beam structure having an upper portion 29, a middle portion 28 extending from the upper portion 29 and a lower portion 24 as shown in FIGS. 1, 3 and 8 of the drawings. The lower portion 24 is preferably comprised of a flat structure transverse with respect to the middle portion 28. The main engaging member 70 is slidably supported upon the lower portion 24 as best illustrated in FIG. 8 of the drawings. Various other elongate support structures may be utilized to construct the support beam 20 instead of an I-beam structure.

Figure 2:
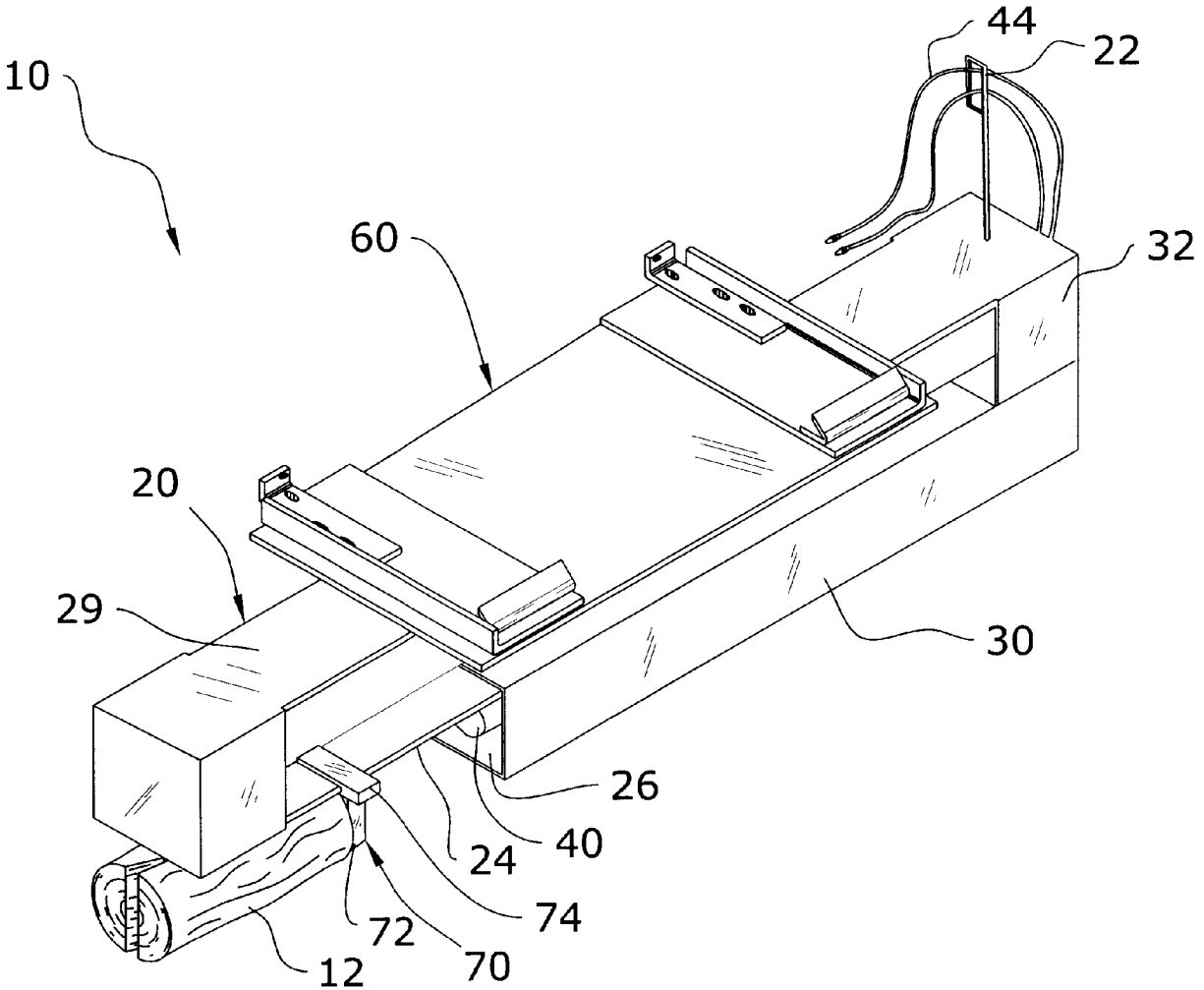
FIG. 2 is an upper perspective view of the present invention.

FIGS. 1 and 3 illustrate a protective member 26 attached to the support beam 20 and surrounding the actuator unit 40. The protective member 26 is to protect the actuator unit 40 from damage during usage. A front engaging member 30 is removably attached to a front of the support beam 20 for allowing the user to push logs 12 and other debris forwardly. A side engaging member 32 is also preferably attached to an end of the support beam 20 for allowing manipulation of logs 12 and debris as shown in FIGS. 1 and 2 of the drawings. Various other engaging structures may be attached to the support beam 20 for manipulating objects and protecting components of the present invention.

C. Loader Connecting Structure

A loader connecting structure 60 is attached to the support beam 20 for attaching to a tractor loader. The loader connecting structure 60 may be attached in various locations upon the support beam 20 such as centrally, forwardly, rearwardly, to the left side or to the right side. The loader connecting structure 60 may be comprised of any connecting structure capable of removably connecting to a loader of a tractor or other vehicle.

U.S. Pat. Nos. 6,520,226 and 6,408,907 teach an exemplary loader connecting structure 60 for skid steer loaders which is a suitable connecting structure for usage within the present invention. U.S. Pat. Nos. 6,520,226 and 6,408,907 are incorporated by reference into this application for the purposes of supporting the loader connecting structure 60.

D. Main Engaging Member

A main engaging member 70 is slidably attached to the support beam 20 for engaging the end of a log 12 as shown in FIG. 1 of the drawings. The main engaging member 70 preferably includes a pair of opposing lip members 74 defining opposing slots for slidably receiving the lower portion 24 of the support beam 20 as shown in FIG. 8 of the drawings. The main engaging member 70 also includes an engaging plate 72 for engaging the end of a log 12 as further shown in FIG. 8 of the drawings. Various other structures may be utilized to construct the main engaging member 70.

E. Splitting Wedge

Figure 6:
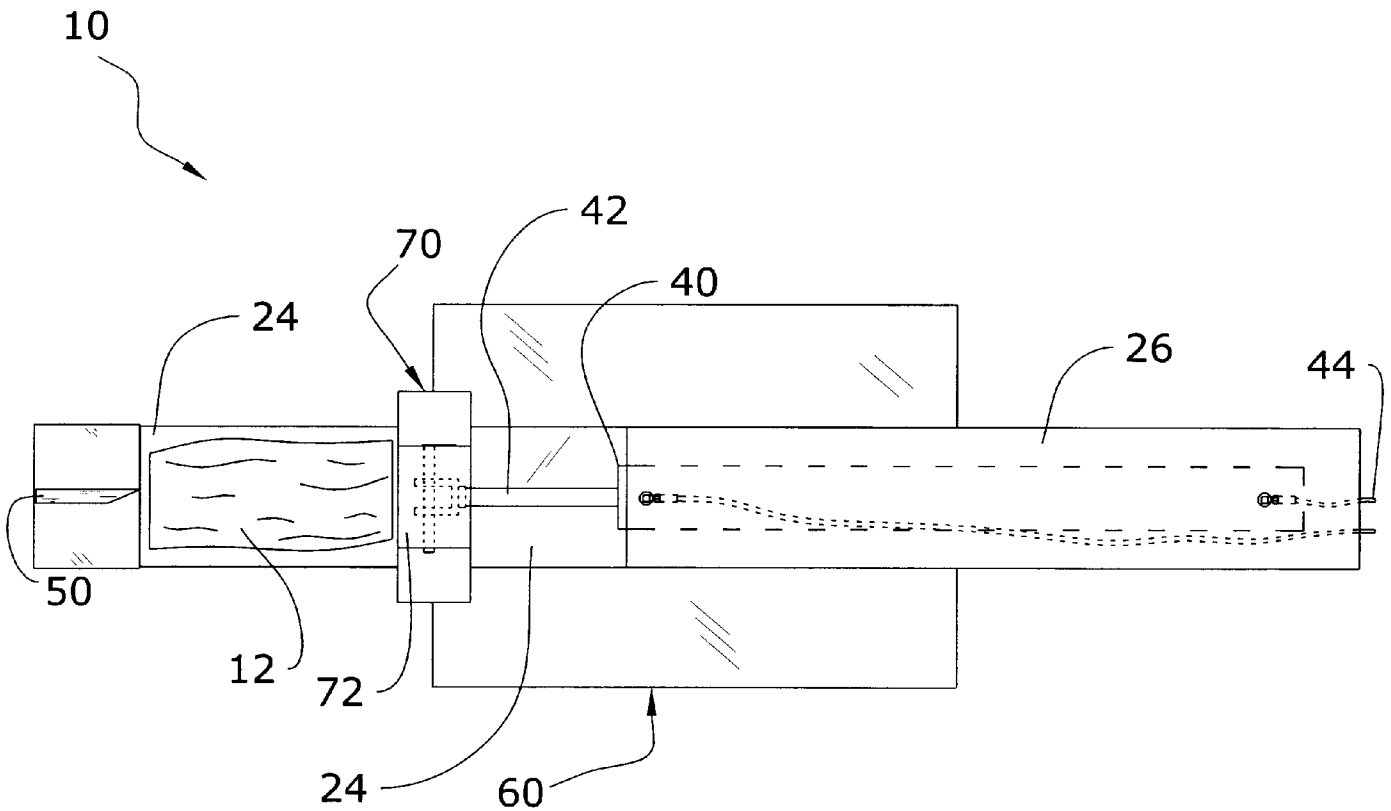
FIG. 6 is a bottom view of the present invention loosely positioned about a log.

A splitting wedge 50 is attached to an end of the support beam 20 as best illustrated in FIGS. 1 and 3 of the drawings. The splitting wedge 50 may be comprised of a single blade structure as illustrated in FIG. 6 of the drawings for splitting the logs 12 pressed against thereof by the main engaging member 70.

Figure 9:
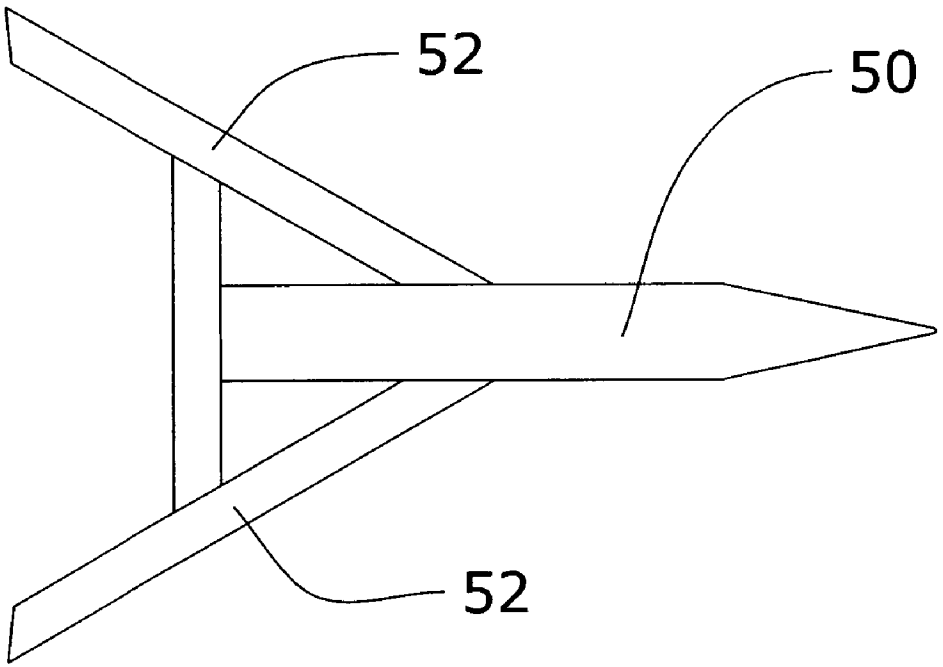
FIG. 9 is a bottom view of an alternative splitting wedge.

However, the splitting wedge 50 may include a pair of wing member 50 extending in a tapered outwardly manner from a single blade structure to facilitate the spreading of the log 12 being split as shown in FIG. 9 of the drawings. The splitting wedge 50 may be comprised of various other well known splitting blade structures which are well known in the art.

F. Actuator Unit

An actuator unit 40 is attached to the main engaging member 70 and the support beam 20 as shown in FIGS. 3 and 4 of the drawings. The actuator unit 40 forces the main engaging member 70 toward the splitting wedge 50 with a log 12 positioned between thereof thereby splitting a log 12 as shown in FIGS. 4 through 7 of the drawings.

The actuator unit 40 may be comprised of a hydraulic cylinder, electrical actuator or a mechanical device powered by a motor. The preferred embodiment of the present invention illustrates an actuator unit 40 with a shaft 42 movably extending from the actuator unit 40 to engage the main engaging member 70.

The actuator unit 40 within the preferred embodiment is comprised of a hydraulic cylinder with connector hoses 44 fluidly connected thereto. The connector hoses 44 have couplers at the distal ends thereof that are fluidly connectable to the auxiliary hydraulic fluid source on the tractor. A hose bracket 22 or other similar structure is preferably attached to the support beam 20 for receiving and supporting the connector hoses 44 to avoid entanglement during operation of the present invention.

G. Operation of Invention

In use, the user attaches the loader of the tractor to the loader connecting structure 60 and the connector hoses 44 to the auxiliary hydraulic fluid source. The user thereafter is able to manipulate the vertical and rotational position of the log 12 splitter system 10 utilizing the tractor's hydraulic system and loader. The user is able to manipulate the horizontal position through forward/rearward movements and rotational movements.

The user first selects a log 12 to be split and thereafter positions the log 12 splitter system 10 about the log 12. The user then extends the actuator unit 40 thereby causing the main engaging member 70 to press the selected log 12 against the splitting wedge 50 in a gripped manner. The user then transports the log 12 to a desired location and contracts the actuator unit 40 thereby allowing the log 12 to drop to the ground surface.

Figure 7:
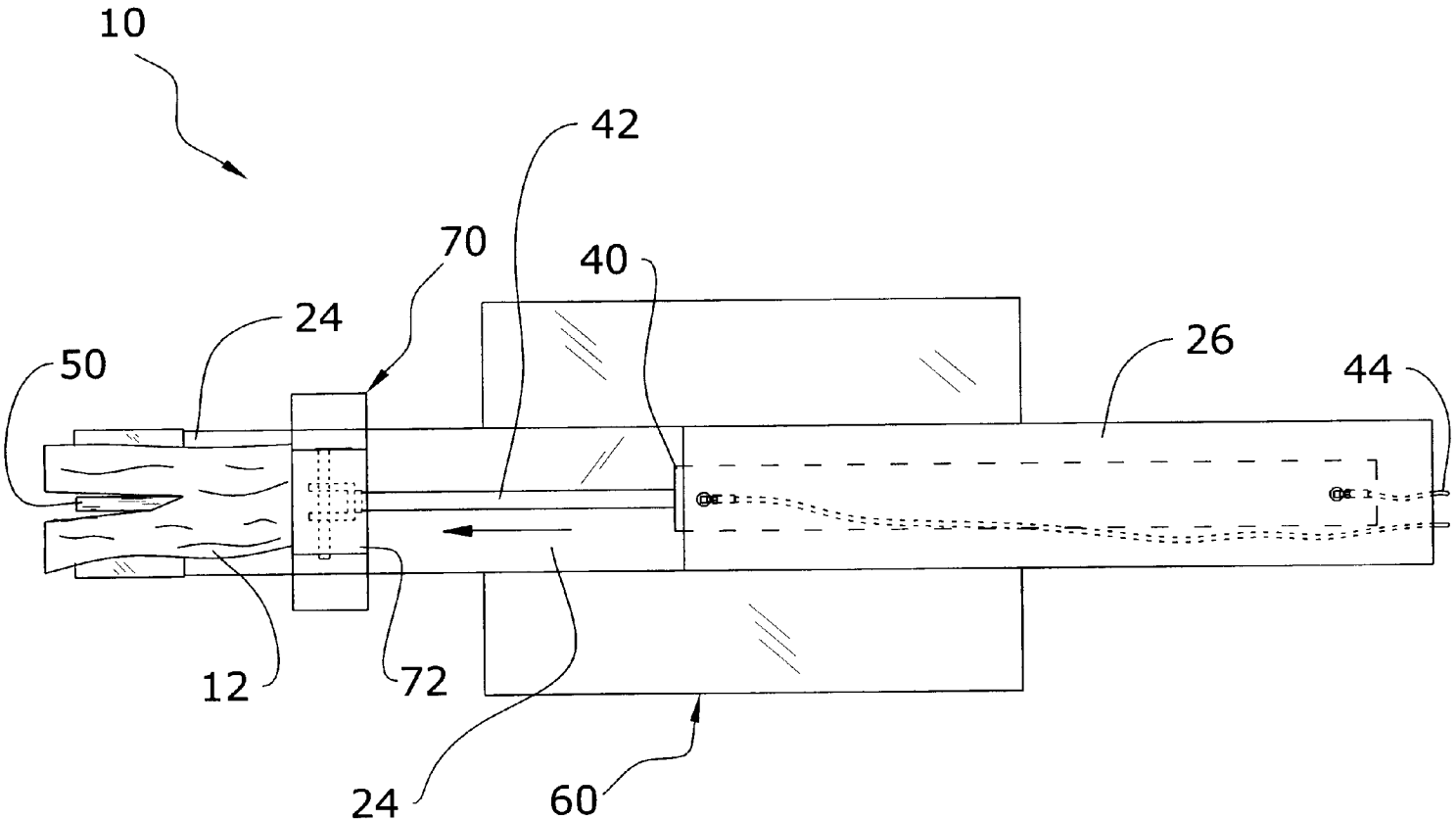
FIG. 7 is a bottom view of the present invention splitting a log.

The user then positions the splitting wedge 50 to face a first end of the log 12 and the main engaging member 70 to face the second end of the log 12. The user then extends the actuator unit 40 thereby causing the main engaging member 70 to slide upon the support beam 20 and engage the second end of the log 12. The actuator unit 40 further extends thereby causing the first end of the log 12 to engage the blade portion of the splitting wedge 50 thereby splitting the first end of the log 12 as shown in FIGS. 2 and 7 of the drawings. The actuator unit 40 continues extending the main engaging member 70 until the log 12 is fully split. The user then contracts the actuator unit 40 and repeats the above process as desired. It should be noted that the user may also utilize the front engaging member 30 and the side engaging member 32 to engage the logs 12 and split logs thereby allowing the user to create piles of logs 12 and split logs as desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A log splitter system, comprising:

a support beam;

a loader connecting structure attached to said support beam for attaching to a tractor loader;

a main engaging member slidably attached to said support beam;

a splitting wedge attached to an end of said support beam;

an actuator unit attached to said main engaging member and said support beam, wherein said actuator unit forces said main engaging member toward said splitting wedge with a log positioned between thereof thereby splitting a log; and a protective member attached to said support beam and surrounding said actuator unit.

2. The log splitter system of claim 1, wherein said support beam is comprised of an elongate structure.

3. The log splitter system of claim 1, wherein said loader connecting structure is centrally attached to said support beam.

4. The log splitter system of claim 1, wherein said support beam is comprised of an upper portion, a middle portion extending from the upper portion and a lower portion, wherein said main engaging member is slidably supported upon said lower portion.

5. The log splitter system of claim 4, wherein said lower portion is comprised of a flat structure transverse with respect to said middle portion.

6. The log splitter system of claim 5, wherein said main engaging member includes a pair of opposing lip members defining opposing slots for slidably receiving said lower portion, and an engaging plate for engaging a log.

7. The log splitter system of claim 6, wherein said support beam is comprised of an I-beam construction.

8. The log splitter system of claim 1, wherein said splitting wedge includes a pair of wing members extending in a tapered outwardly manner from a center blade.

9. The log splitter system of claim 8, wherein said support beam is comprised of an elongate structure.

10. The log splitter system of claim 8, including a front engaging member attached to a front of said support beam.

11. The log splitter system of claim 8, including a side engaging member attached to an end of said support beam.

12. The log splitter system of claim 8, wherein said loader connecting structure is centrally attached to said support beam.

13. The log splitter system of claim 8, wherein said support beam is comprised of an upper portion, a middle portion extending from the upper portion and a lower portion, wherein said main engaging member is slidably supported upon said lower portion.

14. The log splitter system of claim 13, wherein said lower portion is comprised of a flat structure transverse with respect to said middle portion.

15. The log splitter system of claim 14, wherein said main engaging member includes a pair of opposing lip members defining opposing slots for slidably receiving said lower portion, and wherein said support beam is comprised of an I-beam construction.

16. A log splitter system, comprising:

an elongate support beam having an I-beam structure with an upper portion, a middle portion and a lower portion;

a loader connecting structure attached to said support beam for attaching to a tractor loader;

a main engaging member slidably attached to said support beam, wherein said main engaging member includes a pair of opposing lip members defining opposing slots for slidably receiving said lower portion, and an engaging plate for engaging a log;

a splitting wedge attached to an end of said support beam;

an actuator unit attached to said main engaging member and said support beam, wherein said actuator unit forces said main engaging member toward said splitting wedge with a log positioned between thereof thereby splitting a log;

a protective member attached to said support beam and surrounding said actuator unit;

a front engaging member attached to a front of said support beam; and a side engaging member attached to an end of said support beam.

17. A log splitter system, comprising:

a support beam;

a loader connecting structure attached to said support beam for attaching to a tractor loader;

a main engaging member slidably attached to said support beam;

a splitting wedge attached to an end of said support beam;

an actuator unit attached to said main engaging member and said support beam, wherein said actuator unit forces said main engaging member toward said splitting wedge with a log positioned between thereof thereby splitting a log; and a front engaging member attached to a front of said support beam.

18. The log splitter system of claim 17, including a side engaging member attached to an end of said support beam.

19. The log splitter system of claim 17, wherein said support beam is comprised of an upper portion, a middle portion extending from the upper portion and a lower portion, wherein said main engaging member is slidably supported upon said lower portion.

20. The log splitter system of claim 17, wherein said lower portion is comprised of a flat structure transverse with respect to said middle portion.

* * * * *